US005603806A

United States Patent [19]

Kerttula

[11] Patent Number: 5,603,806

[45] Date of Patent: Feb. 18, 1997

[54] METHOD AND APPARATUS FOR LATERAL ALIGNMENT OF THE CROSS-DIRECTION QUALITY PROFILE OF A WEB IN A PAPER MACHINE

[75] Inventor: Reima Kerttula, Muurame, Finland

[73] Assignee: Valmet Corporation, Helsinki, Finland

[21] Appl. No.: 456,800

[22] Filed: Jun. 1, 1995

[51] Int. Cl.[6] ..... D21F 1/08

[52] U.S. Cl. ..... 162/198; 162/258; 162/336; 162/DIG. 11

[58] Field of Search ..... 162/198, 258, 162/259, 262, 263, 336, DIG. 11

[56] References Cited

U.S. PATENT DOCUMENTS

| | | | |
|---|---|---|---|
| 4,874,467 | 10/1989 | Karlsson et al. | 162/259 |
| 4,897,158 | 1/1990 | Weisshuhn et al. | 162/259 |
| 5,196,091 | 3/1993 | Hergert | 162/258 |
| 5,381,341 | 1/1995 | Herrala et al. | 162/252 |
| 5,401,363 | 3/1995 | Begemann et al. | 162/DIG. 11 |

FOREIGN PATENT DOCUMENTS

| | | | |
|---|---|---|---|
| 462472 | 12/1991 | European Pat. Off. | 162/259 |
| 3639823 | 6/1988 | Germany | 162/258 |
| 4008282 | 9/1991 | Germany . | |

*Primary Examiner*—Karen M. Hastings
*Attorney, Agent, or Firm*—Steinberg, Raskin & Davidson, P.C.

[57] ABSTRACT

A method and apparatus for lateral alignment of a cross-direction profile control of a web as required in a paper-making process. In the method, a certain cross-direction profile of a dried web, particularly the basis weight profile thereof, to be aligned is gauged. A profile measurement signal thus obtained is passed to a control system of the paper machine which provides a control signal suited to control adjustment devices of the cross-direction profile control provision. The web is provided with at least one marker line whose lateral shift or shifts is/are detected at the measurement point of the cross-direction profile of the dried web, or in the vicinity thereof. The detection of the lateral shift(s) is used to generate a measurement signal thereof which is employed to control the lateral alignment of the web profile adjustment provision. The information obtained from the detected lateral shift(s) then used in the control of the lateral alignment of the consistency profile control provision adapted in conjunction with the paper machine headbox. The marker agent used to make the marker line is injected to the stock at the inlet side of the stock feed channel to the paper machine headbox, most advantageously close to the control valve set of the consistency profile control provision.

15 Claims, 3 Drawing Sheets

METHOD AND APPARATUS FOR LATERAL ALIGNMENT OF THE CROSS-DIRECTION QUALITY PROFILE OF A WEB IN A PAPER MACHINE

BACKGROUND OF THE INVENTION

The present invention relates to a method of lateral alignment of the cross-direction profile control of a web as required by a papermaking process, in a paper machine, in which a certain cross-direction profile of the dried web, particularly the basis weight profile thereof, to be aligned is gauged or measured, and the profile measurement signal thus obtained is passed to a control system of the paper machine which provides a control signal suited to control the adjustment means of the cross-direction profile control provision. Also, the web is provided with at least one marker line, whose lateral shift or shifts is/are detected at the measurement point of the cross-direction profile of the dried web, or in the vicinity thereof. The detection of the lateral shift(s) is used to generate a measurement signal of the shift(s) which signal is employed to control the lateral alignment of the web profile adjustment.

Furthermore, the present invention relates to a control apparatus for the adjustment and alignment of the cross-direction profile of a web manufactured in a paper machine. The control apparatus comprises a measurement beam or equivalent element adapted to be positioned at the dry end of the paper machine, most advantageously in the vicinity of the reel-up station, a control system to which a measurement signal of the cross-direction profile of the web from a measurement sensor or sensors of the measurement beam is passed, and means which facilitate the cross-direction adjustment of the stock flow profile at the wet end of the paper machine (i.e., in the vicinity of the headbox), most advantageously utilizing a feedback signal formed from the measurement signal obtained from the control system mentioned in the foregoing reference to the paper machine headbox. Also, the apparatus may include an applicator apparatus of a marker line or lines to be made onto the web, sensor means adapted in conjunction with or to the vicinity of a measurement beam or equivalent element, whereby the sensor means is capable of measuring the lateral shift(s) of the marker line(s). The apparatus also has an arrangement suited to control the lateral alignment of the stock flow profile adjustment provision on the basis of the measurement signal indicating the lateral shift(s).

Conventionally, a stock mixture is admitted via the headbox slice of paper or board machines in the form of a suspension jet onto a forming wire in a forming section or into a nip formed between two forming wires in the forming section. The cross-direction profile of the headbox slice determines the cross-direction profile of the discharged stock flow. The slice profile is adjustable and this slice profile control is also capable of compensating for those defects of the stock flow that occur in the headbox or stages preceding it.

Control systems for a paper or board machine are known in the art and are used for the adjustment of a certain cross-direction quality profile of the web being manufactured, particularly its basis weight profile, whereby such a control system comprises a plurality of actuators and a corresponding number of actuator control means. The actuators are arranged to function over the entire width of the web whose profile is to be adjusted. This type of prior art control system incorporates a process control computer or similar logic controller and a feedback loop including the measurement arrangement for the controlled cross-direction profile of the web.

As to the state-of-the-art for above-mentioned control systems of a paper machine, reference is made to Finnish Laid-Open Publication No. 85,731 (corresponding to the assignee's U.S. Pat. No. 5,381,341, the specification of which is hereby incorporated by reference herein, and European Patent Publication No. 0 401 188) filed earlier by the assignee. These documents disclose such a paper machine control system in which the individual actuators are provided with intelligent actuator controllers, and the information transfer in the control hierarchy of the system between a higher level control unit and the controllers of the individual actuators is implemented using a common bus. The control scheme of this control system is based on the distributed intelligence of the actuator controllers, which is parametrized only by the set values issued by the higher-level control system. Each actuator controller is seen by the higher-level system as an individual unit to which the set value is sent via the serial bus in digital format, after which the actuator controller takes care of the mechanical actuation in a self-contained manner based on its stored measurement/control algorithm.

The requirements set on the evenness of cross-direction profiles of both coated and uncoated paper are today tighter than ever primarily due to the elevated quality standards of printing processes and printed material.

However, profile control implemented by means of the lip adjustment of the headbox slice is hampered by certain shortcomings, i.e., that variations in the gap width between the slice lips cause cross-direction flow components in the jet flow of the discharging stock that in turn affect the evenness of the cross-direction profile of the fiber formation in the web. Accordingly, it is desirable to run the headbox with slice profile of maximally constant gap width. Due to these and other reasons, the tendency has recently been to develop and install so-called dilution headboxes in which the basis weight control of the web is principally implemented by controlling the cross-direction consistency profile of the stock flow discharged from the headbox. For practical embodiments of dilution headboxes, reference is made to, e.g., Finnish Patent No. 92228 and Finnish Patent Application No. 942780 filed by the assignee herein (which corresponds to U.S. Pat. No. 5,545,293).

Such consistency profile adjustment is implemented by feeding diluting water to those points of the web formation where the basis weight is higher than average via, e.g., manifold channels of the turbulence generator of the headbox. A problem associated with the use of dilution headboxes may arise therefrom that the web undergoes cross-direction "floating" during its formation and drying process so that the consistency profile adjustment performed based on the basis weight profile measured close to the reel-up end of the paper machine will be laterally misaligned, whereby a lateral shift of the profile control occurs that is extremely detrimental to the end result of the profile adjustment.

When the term dilution headbox is mentioned in the foregoing and later in the text, this term must be understood to generally refer to such headboxes in which cross-direction consistency profile adjustment of the stock flow is used. Such adjustment may also be implemented so that in addition to or instead of the dilution water, controlling stock flows may alternatively be used having a consistency different from the average consistency of the stock in the headbox. Also stock with a consistency higher than the average may be applied via the auxiliary feeds of the cross-direction profile adjustment provision. Lateral shift of the web is caused by the cross-direction shrinkage of the web occurring during the drying cycle of the web that is nonuniform over the width of the web. Such lateral shift is also partially caused by the lateral shifts of the web-supporting fabrics of the paper machine as well as the lateral velocity components of stock flow in the headbox slice channel and the discharged jet.

The dominating cause of the above-mentioned lateral shift is traceable to web shrinkage in the dryer, or more generally, any drying shrinkage in the formation of the web. Maximally the web shrinkage is in the order of about 20 cm to about 40 cm. Moreover, the higher web speeds of modern paper machines elevate the tendency of developing larger web speed differentials along the web path, which further results in length variations of the wires and, hence, the tendency of causing a contracted section in the web. Consequently, the cross-direction shrinkage of the web may be caused by both the drying process and the web speed differentials between the different wire groups along the web path.

The accuracy and stability of the lateral alignment in the control of web basis weight and other similar profiles becomes problematic particularly in conjunction with paper grade changes at the paper machine. It is conventional to operate such paper machines in which during each day the number of grade changes may mount up to several tens. By means of prior art control systems, the above-described lateral alignment of profile adjustment provision has been a difficult and time-consuming operation, whereby also the accuracy of such alignment leaves room for improvement. Such shortcomings may lead to lower availability of paper machines and even paper quality problems.

Conventionally, the lateral alignment of the cross-direction profile has been implemented using a method in which the adjustment screw of a certain headbox slice section is operated to cause a distinct change in the slice gap width at the adjustment screw and the effect of the change is measured with the help of the measurement beam of the basis weight profile at the dry end of the paper machine close to the reel-up station. This alignment method is hampered by its inaccuracy, since the change in the basis weight profile caused by means of the adjustment screw is extremely faint and flat.

Also known in the art for the above-mentioned lateral alignment is such a manual method in which a marker agent is injected into the stock jet discharged from the headbox and the lateral shift of the mark thus generated is detected, e.g., visually.

With regard to the state-of-the-art related to the present invention, reference is made to German Patent Publication No. DE 40 08 282 A1 (assigned to J. M. Voith GmbH). This publication discloses a method and apparatus employed for the lateral alignment of a cross-direction property profile of a paper web similar to that defined in the introductory part of the present patent application. This publication describes an injection header of marker lines suited to be placed at the dryer section of a paper machine, whereby the injection header is used to inject over the entire width of the paper web a series of mutually parallel marker lines, which are employed to determine the cross-direction shrinkage of the paper web. Additionally, the German publication mentions casually that such a shift measurement of the marker lines can be used for the control of the headbox slice lip. However, the principal content of the German publication relates to the control of web moisture profile modifying equipment of the dryer section along the paper web path such as steam boxes or infra-red radiant heaters.

One particular shortcoming of the method and apparatus disclosed in above-mentioned German publication is its incapability of determining the effect of cross-direction flow components occurring inside the paper machine headbox on the alignment of the cross-direction basis weight profile of the paper web. This disadvantage has been found particularly problematic in the dilution headbox, or consistency profile controlled headbox, which was mentioned above and will be described later in greater detail, because provided that the afore-mentioned shortcoming could be removed, this type of headbox can offer more accurate and defined control of basis weight than is conventional in the art.

OBJECT AND SUMMARY OF THE INVENTION

Accordingly, it is an object of the present invention to achieve such a control method and apparatus for a paper machine that are capable of essentially overcoming the above-discussed problems.

To achieve this object and others, in the control method in accordance with the invention, the cross-direction alignment of the consistency profile adjustment provision adapted to the paper machine headbox is controlled on the basis of the above-described detection of the lateral shift of the web. In detail, the cross-direction profile of the dried web is measured at a measurement location and a profile measurement signal is generated based thereon, the profile measurement signal is input to a control system and an output control signal based thereon is generated, a lateral shift of the at least one marker line is detected at or in the vicinity of the measurement location from its position at the headbox discharge and a measurement signal based thereon is generated, and the consistency of the stock flow in the headbox in the cross-direction is adjusted based on the control signal in conjunction with the measurement signal of the detected lateral shift to control the cross-direction profile of the web characteristic.

Correspondingly, the apparatus according to the invention comprises a consistency profile adjustment provision adapted to the paper machine headbox and an arrangement in which the lateral alignment of the consistency profile control provision is adapted to be controlled on the basis of the above-mentioned lateral shift feedback signal.

An important advantage of the present invention over the prior art is that the lateral shift of the web detected by means of the marker line(s) is employed specifically in the control of the lateral alignment of the consistency profile adjustment provision adapted in conjunction with the paper machine headbox, whereby paper grades of improved basis weight profile over the prior art can be manufactured. An additional benefit of the invention is that also the cross-direction fiber orientation profile of the web can be made more homogeneous than in the prior art, because the headbox can be run with a more constant gap width of the headbox slice, whereby the cross-direction components of stock flow that determine the fiber orientation profile can be minimized.

In a particularly advantageous embodiment of the invention, when the marker agent is admitted along with the dilution water or equivalent medium of the consistency profile adjustment provision, that is, prior to the turbulence generator(s) of the headbox and its slice, most preferably immediately after the flow header of the headbox, the lateral shift of the marker line(s) can be made to further reflect such lateral shift components as those related to the cross-direction shifts of the stock flow, cross-direction shifts of the stock jet discharged from the slice and the cross-direction shifts of the paper machine web-forming wire and press fabrics. Accordingly, the consistency profile adjustment can be implemented in a more accurate and detailed manner than in the prior art and even a denser cross-direction spacing of the distribution points of the dilution water or equivalent profile control medium can be employed. Hence, a web with an improved basis weight and cross-direction fiber orientation profile over the prior art can be produced.

In the following the invention is described in greater detail with reference to a few exemplifying embodiments of the invention illustrated in the diagrams of the appended drawings, whereby the details of the illustrations are only exemplary and must not be understood in any manner to restrict the scope of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
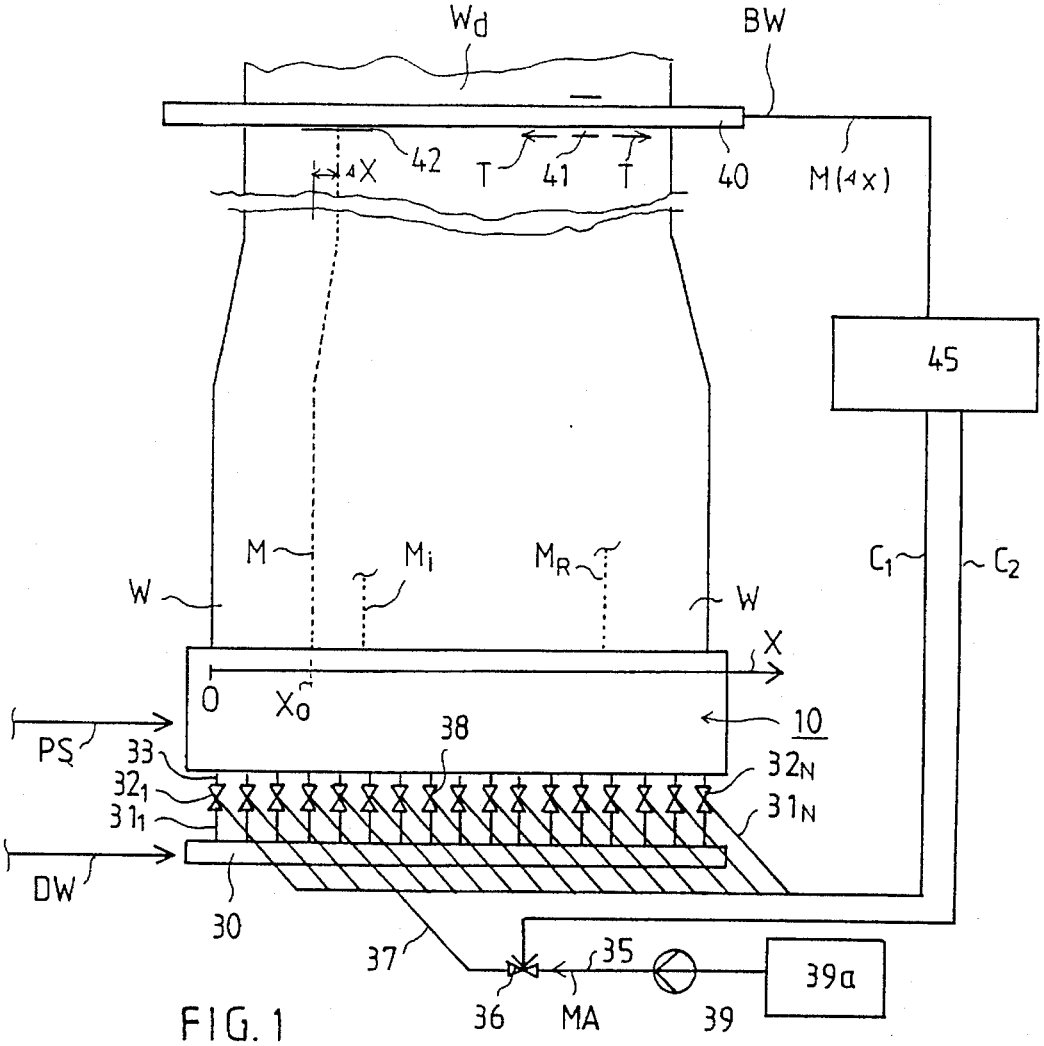
FIG. 1 illustrates the paper-making process and its control principle in a schematic top view partially complemented with a block diagram.
Figure 3:
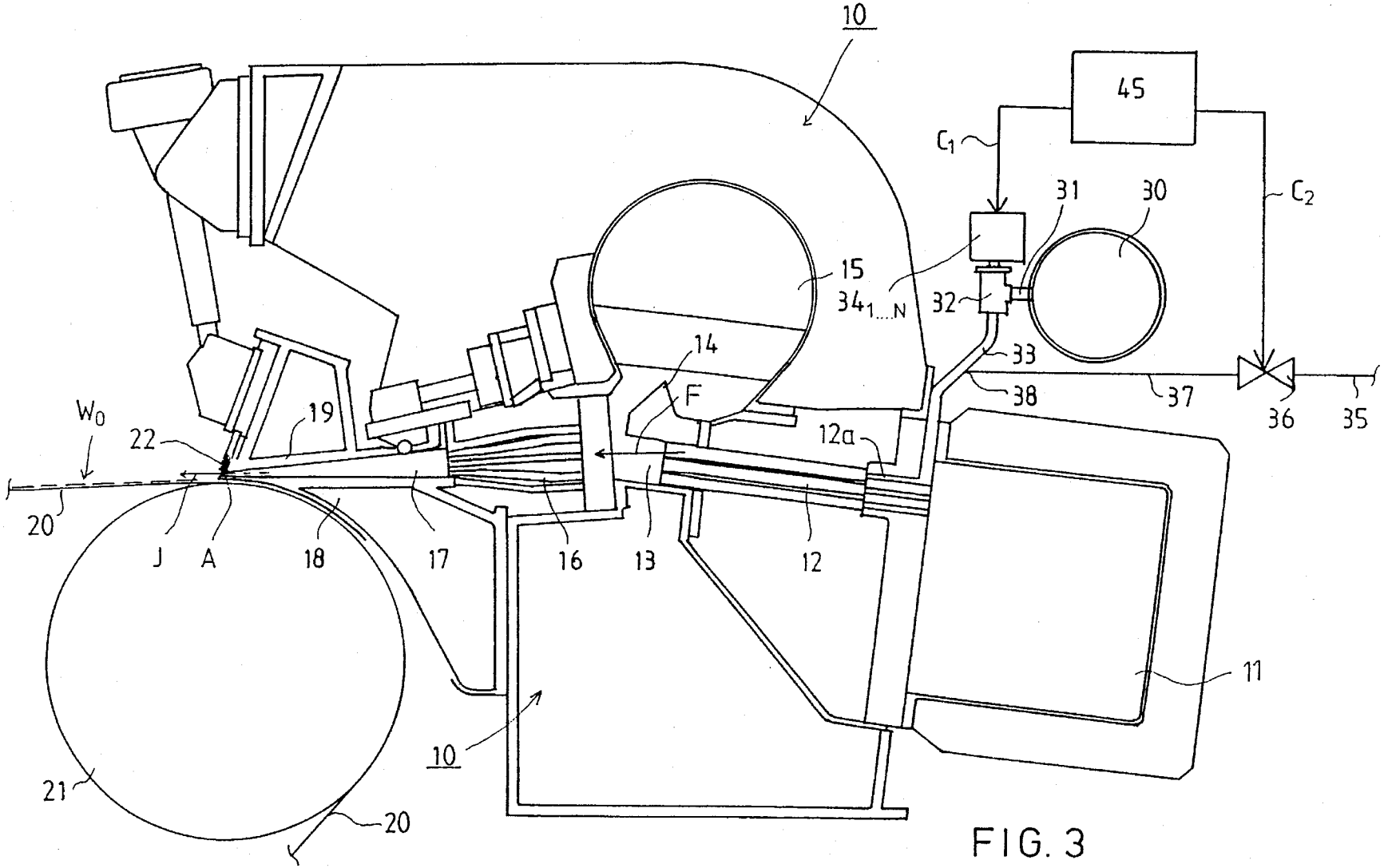
FIG. 3 is a diagrammatic machine-direction sectional side dilution headbox suited to implement the method according to the invention.

Referring principally to FIGS. 1 and 3, an exemplifying construction of a dilution headbox is initially described suited for use as the operating environment of the embodiment according to the invention. At this preliminary juncture, it must be noted that the invention is also applicable to a number of other types of dilution headboxes. Notwithstanding the use of the term dilution headbox in the foregoing and later in the text, this term must be understood to refer to any headbox with an adjustable consistency profile in which the profile adjustment provision is implemented by feeding the headbox slice with sectional stock flows of different consistencies. With reference to drawings, a headbox 10 incorporates a flow header 11 into which stock is received as indicated by arrow PS in FIG. 1. From the header 11, the stock is divided via a flow distribution inlet piping 12 to an equalizing chamber 13 which is coupled to a pressurized-air-padded headbox air chamber 15 having a stock overflow dam 14. After the equalizing chamber 13 in the flow direction is a multi-pipe turbulence generator 16 comprising a set of parallel and superimposed pipes. The turbulence generator 16 exits in the flow direction F of the stock or fiber suspension into a slice chamber 17 from which a stock or fiber suspension jet J is discharged via a slice A onto a forming wire 20 running over a breast roll 21, or alternatively, into a forming nip between two wires (not shown), or any other forming section. Adapted to the slice A is a lip 22 whose profile is adjusted by means of a set of adjustment screws (not shown) actuated by actuator motors (not shown) in a conventional manner using a method described, e.g., in Finnish Laid-Open Publication No. 85,731 filed by the assignee herein.

Referring now in particular to FIG. 1, the cross-direction profiles, particularly the basis weight profile and the moisture content profile, of a dried web Wd are measured at the dry end of a paper machine just prior to the reel-up station by means of a measurement beam 40 equipped with a carriage 42 which performs gauging by traversing over the web in the cross-machine direction T—T. The resulting measurement signal values BW of the cross-direction basis weight profile are taken to a process control system 45 of the paper machine, which may further be connected to, e.g., a plant process computer (not shown).

Referring to FIGS. 1 and 3, the headbox shown in the diagrams is provided with a cross-direction consistency profile adjustment, that is, a cross-direction dilution profile control over the width of the web W in which control scheme, a feedback signal $C_1$ generated in the process control system 45 is employed to control the cross-direction consistency profile of the stock jet J discharged from the headbox and thereby particularly the cross-direction basis weight profile BW of the dried web Wd. The arrangement adapted for the dilution control comprises a feed header 30 for the dilution water, which may be, e.g., drainage water from the wire or stock with a consistency lower than the average, the feed header extends over the entire width of the headbox 10. The dilution water or equivalent medium is admitted into the feed header 30 in the direction of arrow DW. A set of distribution pipes $\mathbf{31}_1$–$\mathbf{31}_N$ leaving the feed header 30 is provided with a set of control valves $\mathbf{32}_1$–$\mathbf{32}_N$. The valve set 32 is connected by a distribution pipe set 33 to distribution pipes **12*a* located close to the front wall of the headbox flow header 11, and before the flow distribution inlet piping 12. The control valve set 32 is equipped with a set of actuators $\mathbf{34}_1$–$\mathbf{34}_N$ controlled by a set of control signals $C_1$ issued by the control system 45**. The value of the subindex N refers to the number of adjustable feed points of dilution water. The number N in normally chosen to be from about 100 to about 250, whereby in a paper machine with a normal web width (approximately 8 m), the mutual cross-direction spacing of the dilution feed points will be in the range from about 30 mm to about 80 mm.

The dilution control principally functions in a conventional manner so that if a sensor 41 located at some point k along the cross-direction axis E above the web detects a basis weight greater than the average, the feedback loop 41,BW,45,$C_1$,32 steers the control valve $\mathbf{32}_n$ at the corresponding cross-direction location above the web to release more dilution water into the corresponding distribution pipe **12*a* of the distribution pipe set 12**, whereby a desired downward correction of basis weight is achieved at that cross-direction point $x_k$. As described above, the accuracy of the lateral alignment of profile correction on the cross-direction axis has been wanting, particularly in conjunction with grade changes or long runs.

Figure 2:
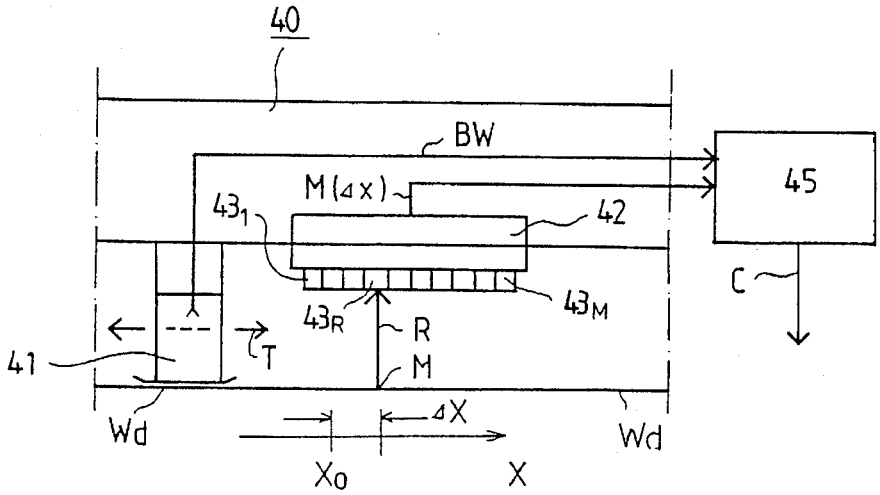
FIG. 2 is a diagrammatic illustration of the measurement beam employed in the invention and the marker line detector adapted thereto as viewed in the machine direction.

Referring now principally to FIGS. 1, 2 and 3, an advantageous embodiment of the invention is described in the following. As shown in FIGS. 1 and 3, to one of the dilution water feed pipes or distribution set pipes 33 after the control valve 32 thereof, at point 38, a marker agent injection pipe 37 is connected into which the marker agent is dosed via a control valve 36 from a marker agent source **39*a* via a pump 39 and an inlet pipe 35. The function of the control valve 36, principally in an on/off fashion, is controlled by a control signal $C_2$ issued by the control system 45**.

The marker agent is most advantageously admitted in conjunction with grade change at the paper machine by means of the marker agent injection system 35–39 into a dilution water feed pipe 33 located at a cross-direction point $x_0$ above the web. As a result, the paper web W is marked with a marker line M forming a kind of cross-direction "reference" line at the marker agent injection point $x_0$. As the web W undergoes a possible cross-direction "drift" and shrinkage due to reasons described above, on reaching the measurement beam 40, the marker line M on the dried web Wd has shifted by a cross-direction distance Δx relative to the initial injection point $x_0$ of the marker line M. It must be noted herein that the web path in FIG. 1 between the headbox 10 and the measurement beam 40 includes such sections as the paper machine former, dryer, press and a possible finishing section, e.g., a sizing press and/or a machine-glaze calender, all of which are not shown, and that the measurement beam 40 is positioned just prior to the reel-up section (not shown).

Referring to FIGS. 1 and 2, the measurement beam 40 is adapted to carry a measurement apparatus or carriage 42 capable of detecting the cross-direction shift Δx of the marker line M. This measurement apparatus may be formed by, e.g., a set of radiation sensors $\mathbf{43}_1$–$\mathbf{43}_M$. That sensor $\mathbf{43}_R$ of the set which coincides with the marker line M receives the maximum intensity of radiation R and issues the corresponding position signal M(Δx) via the measurement apparatus to the control system 45 which further issues a control signal $C_1$ for the control of the actuator element set $\mathbf{34}_1$–$\mathbf{34}_N$ of the control valve set $\mathbf{32}_1$–$\mathbf{32}_N$.

Referring now specifically to FIG. 2, the measurement beam apparatus 42 of the web shift Δx mounted in a stationary position on the measurement beam 40 can be replaced by an equivalent traversing measurement apparatus particularly if the marker lines Mi are made over the entire width of the web W. The traversing measurement apparatus 42 may be combined with the traversing sensor 41 that gauges the cross-direction basis weight profile BW of the web Wd.

The marker agent for the marker line M may be selected, e.g., from the group of fluorescent chemicals conventionally used in paper web coats. An example of one suitable agent is a fluorescent chemical belonging to the trade mark family TRASAR®T (manufactured by Nalco Chemicals Company) which agent is used as a marking chemical in industry. With the use of fluorescent marker agents, the area about the marker line M is flooded with ultra-violet light and the position of the marker line M is detected by means of conventional optical sensors such as a CCD (charge coupled device) array thereof.

Alternatively, an optical sensing arrangement based on light transmission through the web W or a similar principle may be used in the detection of the lateral shift Δx of the marker line M. Also other kinds of marker lines M compatible with optical detection may be used. Further, the marker agent may be selected from the group of radioactive isotopes having a sufficiently short half-life, typically in the order of about 10 minutes to 20 hours. The marker agent is appropriately selected such that it does not cause defects on the finished sheet. In exceptional cases, also visible marker agents, e.g., dyes can be used, whereby the length of web containing the marker lines injected at, e.g., the start of a grade change may be taken to the broke or trimmed off at the slitter.

The invention can also utilize a greater number of marker lines than one, whereby the marker lines are advantageously spaced symmetrically about the machine center line to those web areas where the greatest changes in the basis weight profile occur. Marker lines indicated by lines $M_i$ and $M_R$ in the diagram of FIG. 1 refer to the possibility of a plurality of marker lines. The number R of the marker lines is typically selected to be approximately in the range of 1 to about 300. When multiple marker lines are employed, a "mapping" of the cross-direction coordinates x of the web W is achieved at the plane of the measurement beam 40. Moreover, the use of multiple marker lines spaced sufficiently densely permits the detection of the cross-direction shrinkage profile of the web W from the mutual distances between the marker lines, whereby this information can be used in the control of the paper machine.

Furthermore, the marker line M, or alternatively, the marker lines M, $M_1$, $M_R$ can be used to detect, and in special cases, even to control the cross-direction alignment of the web W and/or the lateral position of the press or dryer fabrics.

The marker line M need not be continuous, and it need not be applied continuously during the manufacture of the web W. The marker line M may be comprised of dots or dashes accomplished by means of the control valve 36 and the control signal $C_1$. Most preferably the marker line M or the marker lines $M_1$,$M_R$ are applied after the machine has stabilized subsequent to a grade change, and the lateral shift Δx, or alternatively, the lateral shifts $\Delta x_i$ measured at several points across the web is/are measured, and the lateral shifts are stored in the memory of the control system 45 or a host process computer and are used for the cross-direction alignment of the dilution control during the entire run of the grade. If the sheet grade under production is run for a longer time, or a change of process parameter(s) or a disturbance occurs during the run, the lateral shift Δx or shifts Δxi can be recalibrated.

Figure 4:
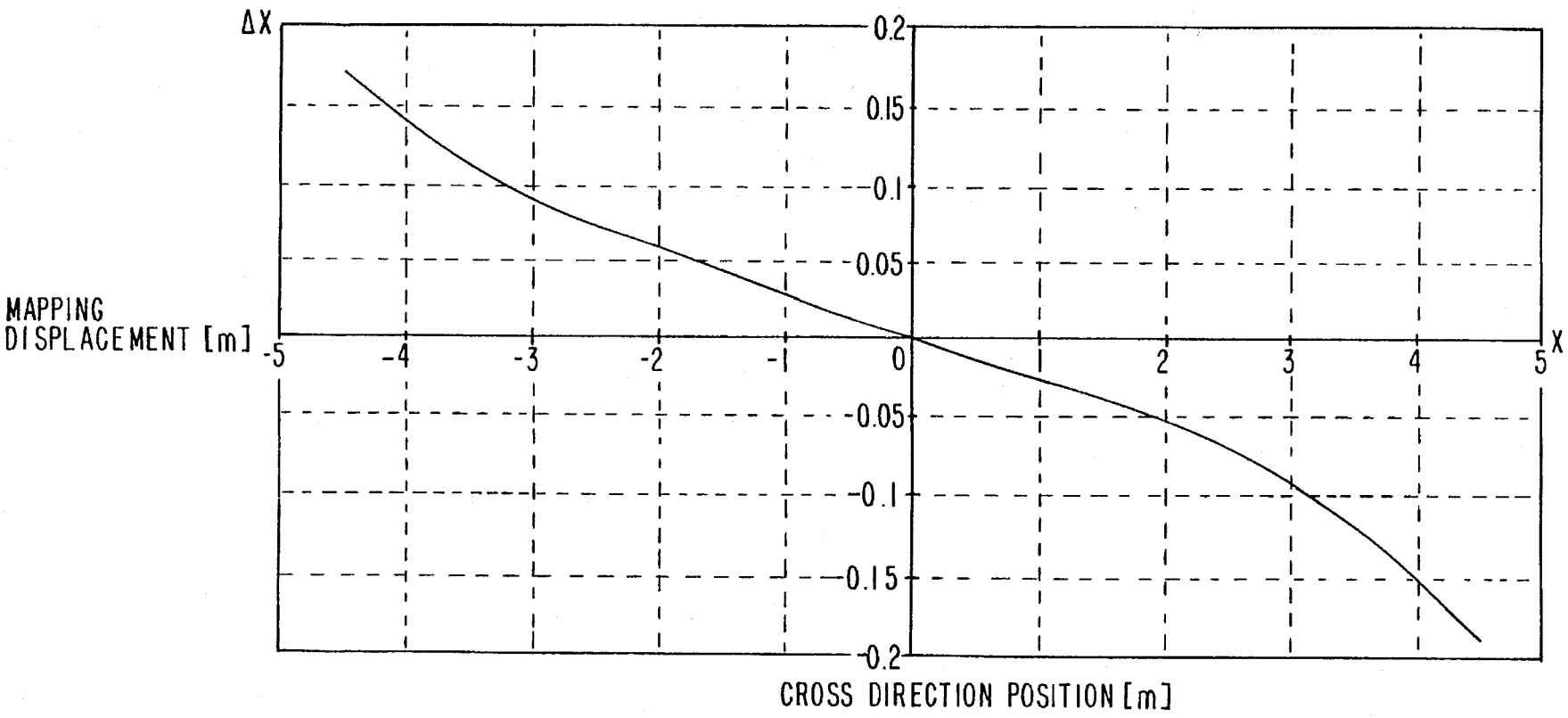
FIG. 4 is a graph illustrating the lateral shift of the web in a paper machine over the entire width of the web (cross-directionally) caused by web shrinkage.

Referring to FIG. 4, the background of the invention is illustrated by a graph depicting the lateral shift Δx of the web measured from a paper machine, whereby the shift is caused by the cross-direction shrinkage of the web W. In the graph shown in FIG. 4, the vertical axis represents the lateral shift Δx of the web, while the horizontal axis is the cross-machine coordinate with the origin aligned at the center line of the paper machine. As can be seen from FIG. 4, the lateral shift Δx caused by the cross-direction shrinkage in a 9 m wide web is maximally approximately 170 mm to about 180 mm at the web edges, while the shift naturally is about 0 at the machine center line.

As is further evident from FIG. 4, the shrinkage related to the drying of the web and the lateral shift of the web caused thereby is a monotonous function of the x coordinate and generally essentially symmetrical about the machine-direction center line of the web. Based on this fact, the invention can utilize models of cross-direction shrinkage stored for different paper grades in the memory of the control system 45 or the host computer connected thereto. Such models can be updated even as simply as by measuring the lateral shift Δx of a single marker line. Additionally, the center line of the web or any other suitable, freely selectable point of the web may be marked with another marker line which can be used to determine a lateral shift caused by another reason than the cross-direction shrinkage of the web and to resolve the need for the lateral alignment of the consistency profile control of the paper machine headbox. A particularly advantageous embodiment of the invention uses three marker lines $M_1$, $M_2$ and $M_3$ of which the center line is aligned with the center line of the web W and the two other lines are applied close to the edges of the web. The lateral lines $M_1$ and $M_3$ principally serve to indicate the lateral shift Δx of the web caused by the cross-direction shrinkage, while the lateral shift caused by other reasons than cross-direction shrinkage can be detected from the position of the center line $M_2$.

Without departing from the scope and spirit of the invention, the different details of the invention can be varied widely. For instance, different combinations of marker agents and marker detecting sensors may be used in conjunction with different paper grades.

The examples provided above are not meant to be exclusive. Many other variations of the present invention would be obvious to those skilled in the art, and are contemplated to be within the scope of the appended claims.

I claim:

1. A method for controlling a cross-direction profile of a web characteristic in a paper machine in which a stock flow is discharged from a headbox to form a web which is then dried in the paper machine, the web having at least one marker line at its discharge from the headbox, comprising the steps of:

measuring the cross-direction profile of the web characteristic of the dried web at a measurement location and generating a profile measurement signal based thereon, inputting the profile measurement signal to a control system and generating an output control signal based thereon, detecting a lateral shift of the at least one marker line at or in the vicinity of the measurement location from its position at the headbox discharge and generating a measurement signal based thereon, adjusting the consistency of the stock flow in the headbox in the cross-direction based on the control signal in conjunction with the measurement signal of the detected lateral shift to control the cross-direction profile of the web characteristic, said headbox stock flow consistency adjusting step comprising the steps of providing a control valve set having a plurality of valves, directing an outlet line of each of said valves to a respective one of a plurality of locations in the cross-direction of the stock flow in the headbox, and controlling the flow of a control medium having a consistency different than the consistency of the stock flow through said valves into the stock flow in the headbox to affect the consistency of the stock flow in the headbox in the cross-direction, and injecting a marker agent through a flow line coupled to at least one of said valves such that the marker agent flows with control medium into the stock flow in the headbox at a respective one of said plurality of locations to form the at least one marker line.

2. The method of claim 1, wherein the web characteristic is the basis weight profile of the web.

3. The method claim 1, further comprising the step of providing the web with between 1 and about 300 marker lines extending in the cross-direction.

4. The method of claim 1, wherein the marker agent is a material suited to detection by radiation.

5. The method of claim 1, wherein the marker agent is a fluorescent chemical.

6. The method of claim 1, wherein the control medium has a consistency lower than the consistency of the stock flow in the headbox to thereby constitute a diluting flow.

7. A control apparatus for adjustment and alignment of a cross-direction profile of a web characteristic in a paper machine in which a stock flow is discharged from a headbox to form the web which is then dried in the paper machine, comprising measurement means for measuring the cross-direction profile of the web characteristic of the dried web at a measurement location and for generating a measurement signal based thereon, a control system coupled to said measurement means for receiving said measurement signal and generating a control signal based thereon, applicator means for applying at least one marker line to the stock flow at or before its discharge from the headbox, sensor means arranged in conjunction with said measurement means for measuring a lateral shift of said at least one marker line at or in the vicinity of the measurement location from its position at the headbox discharge and for providing a measurement signal based on said measured lateral shift, said sensor means being coupled to said control system, and adjustment means for adjusting the consistency of the stock flow in the headbox in the cross-direction based on the control signal in conjunction with the measurement signal of said detected lateral shift to control the cross-direction profile of the web characteristic, said adjustment means comprising a feed header for a control medium having a consistency different than the consistency of the stock flow in the headbox and a set of feed and control elements connected to said feed header for releasing the control medium into the stock flow in the headbox at a respective one of a set of locations in the cross-direction, said applicator means comprising a marker agent injection pipe in flow communication with at least one of said feed and control elements and through which a marker agent is injectable into said at least one of said water feed and control elements to form said at least one marker line.

8. The apparatus of claim 7, wherein each of said feed and control elements is arranged at a respective one of said plurality of locations extending in the cross-direction.

9. The apparatus of claim 7, wherein said adjustment means further comprise a control valve connected to said marker agent injection pipe, said control valve being controlled by a paper machine control system, said applicator means further comprising a source of the marker agent and a marker agent feed pump coupled to said marker agent source for pumping the marker agent from said marker agent source into said at least one of said feed and control elements through said control valve.

10. The apparatus of claim 7, wherein said sensor means comprise a radiation sensor connected to said measurement means.

11. The apparatus of claim 7, wherein said marker agent injection pipe is arranged to feed the marker agent in conjunction with said adjustment means.

12. The apparatus of claim 7, wherein the control medium has a consistency lower than the consistency of the stock flow in the headbox to thereby constitute a diluting flow.

13. The apparatus of claim 7, wherein the headbox is coupled to a pulp header and includes a bank of distribution pipes in flow communication with said pulp header, each of said feed and control elements including a flow line leading into a respective one of said distribution pipes.

14. The apparatus of claim 7, wherein the marker agent is a material suited to detection by radiation.

15. The apparatus of claim 7, wherein the marker agent is a fluorescent chemical.

* * * * *